US008530798B2

(12) United States Patent
Aldana Arjol et al.

(10) Patent No.: US 8,530,798 B2
(45) Date of Patent: Sep. 10, 2013

(54) HOB HAVING A TEMPERATURE SENSOR

(75) Inventors: Oscar Luis Aldana Arjol, Zaragoza (ES); Sergio Llorente Gil, Zaragoza (ES); David Paesa Garcia, Zaragoza (ES); Carlos Sagües Blázquiz, Zaragoza (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 13/375,244

(22) PCT Filed: May 27, 2010 (Under 37 CFR 1.47)

(86) PCT No.: PCT/EP2010/057323

§ 371 (c)(1), (2), (4) Date: Feb. 15, 2012

(87) PCT Pub. No.: WO2010/139598

PCT Pub. Date: Dec. 9, 2010

(65) Prior Publication Data

US 2012/0168425 A1 Jul. 5, 2012

(30) Foreign Application Priority Data

Jun. 1, 2009 (ES) ..... 200930236

(51) Int. Cl.
*H05B 1/02* (2006.01)

(52) U.S. Cl.
USPC ..... 219/482; 219/492; 219/481; 219/448.11

(58) Field of Classification Search
CPC ..... H05B 1/02; H05B 3/68
USPC ..... 219/482, 494, 492, 501, 621, 627, 219/667, 443.1, 446.1, 448.11, 448.12, 448.14
See application file for complete search history.

(56) References Cited

U.S. PATENT DOCUMENTS 4,493,980 A 1/1985 Payne et al.
6,118,105 A * 9/2000 Berkcan et al. ..... 219/497
6,462,316 B1 10/2002 Berkcan et al.

(Continued)

FOREIGN PATENT DOCUMENTS

CN 1243688 A 2/2000
CN 1728019 A 2/2006
DE 19821439 A1 11/1999

OTHER PUBLICATIONS

International Search Report PCT/EP2010/057323.

(Continued)

*Primary Examiner* — Mark Paschall
(74) *Attorney, Agent, or Firm* — James E. Howard; Andre Pallapies

(57) ABSTRACT

A hob includes at least one heating zone, a temperature sensor for detecting the temperature of a cookware element placed on the heating zone, and a control unit for operating the heating zone. The control unit is constructed to heat up the cookware element in a heat-up phase and to control the temperature of the cookware element to a target temperature in a holding phase in at least one operating mode. In order to enable an energy-saving simmer operation, the control unit detects a boiling point of the liquid contained in the cookware element during the heat-up phase and determines the target temperature as a function of the boiling point.

16 Claims, 2 Drawing Sheets

(56) References Cited

U.S. PATENT DOCUMENTS

| | | | | |
|---|---|---|---|---|
| 6,818,867 | B2 * | 11/2004 | Kressmann | 219/441 |
| 8,097,834 | B2 * | 1/2012 | Scott et al. | 219/441 |
| 2005/0286609 | A1 | 12/2005 | Smolenski et al. | |
| 2006/0081607 | A1 * | 4/2006 | Niiyama et al. | 219/497 |
| 2007/0062930 | A1 | 3/2007 | Swan et al. | |
| 2007/0228031 | A1 * | 10/2007 | Alves et al. | 219/448.11 |
| 2009/0294433 | A1 | 12/2009 | Thimm et al. | |
| 2009/0302025 | A1 * | 12/2009 | Corkin | 219/445.1 |
| 2011/0114632 | A1 * | 5/2011 | Paderno et al. | 219/621 |

OTHER PUBLICATIONS

National Search Report ES P200930236.
Report of Examination CN 201080024112.0 dated Feb. 18, 2013.

* cited by examiner

HOB HAVING A TEMPERATURE SENSOR

BACKGROUND OF THE INVENTION

The invention relates to a hob having at least one heating zone and a temperature sensor according to the preamble of claim 1 and to a method for operating a hob according to the preamble of claim 8.

A hob having a heating zone and a temperature sensor located in the center of the heating zone is known from DE 10 2006 057 885 A1. A method is described by which an instant at which the liquid in the cookware element reaches a boiling point is predicted as accurately as possible. The cookware contents are prevented from boiling by reducing the supply of heating energy before boiling point is reached. Predicting is based on evaluating characteristic temperature curves recorded in the past.

Different liquids' boiling points can, though, in practice differ greatly depending on, for instance, their composition and/or the prevailing atmospheric pressure. The same applies to the shape of temperature curves, which is unpredictable for the hob's control units also through the addition of ingredients during the heating-up process. However, precisely predicting the boiling point is important for realizing an effective simmer operation of the hob during which the contents of the cookware element are kept at a temperature just below boiling point. A large amount of energy can be saved by simmering compared with vigorous boiling because the evaporation energy released as a result of boiling can be very high. If, though, the temperature of what is being cooked is too low and the difference between said temperature and boiling point is too great, the cooking process will be protracted and/or lead to undesired results.

BRIEF SUMMARY OF THE INVENTION

The object of the invention is hence in particular to enable an energy-saving simmer operation at a target temperature precisely coordinated with the cookware contents' boiling point. Said object is achieved in particular by means of the features of the independent claims. Advantageous embodiments and developments of the invention will emerge from the subclaims.

The invention proceeds in particular from a hob having at least one heating zone, a temperature sensor for detecting the temperature of a cookware element placed on the heating zone, and a control unit for operating the heating zone. The control unit is designed so that in at least one operating mode it will heat up the cookware element during a heating-up phase and regulate the cookware element's temperature to a target temperature during a holding phase.

It is proposed for the control unit to be designed to detect a boiling point of the liquid in the cookware element during the heating-up phase and determine the target temperature as a function of the boiling point. The purpose is accordingly for the boiling point to be measured during the heating-up phase itself and not, say, in a series of complex trials with different cookware contents. Detecting the boiling point directly will make it possible to dispense with error-prone predictions and estimations of the boiling point. The heating-up phase will accordingly last at least until the boiling point has been reached. The boiling point will be determined very precisely because errors in predicting or estimating it can be avoided through measuring it directly. The target temperature during the heating phase, which can in particular be a simmer temperature, can thus be precisely determined as a function of the boiling point.

In particular the target temperature can be selected as being a predefined temperature difference lower than the boiling point. The energy consumption accompanying vigorous boiling can be avoided thereby and a fast cooking process ensured. The temperature difference can be in particular between 2° and 7° C.

For detecting the boiling point the control unit can record a temperature curve of the cookware element particularly during the heating-up phase and detect a substantially constant section along the temperature curve. The temperature of the cookware contents will not increase further on reaching the boiling point, which will result in a constant temperature on the outside of the cookware. A temperature averaged within the constant section can be used as the measurement value for the boiling point. The temperature sensor's signal can be filtered and/or averaged or subjected to suitable scale transforming generally in a manner appearing appropriate to a person skilled in the relevant art.

For detecting the constant section of the temperature curve the control unit can in particular form a gradient of the temperature curve. The temperature curve can be classified as "substantially constant" if the gradient is below a specific threshold.

Safety shutdown can be ensured if the control unit is designed to deactivate the operating mode and produce a warning signal if the temperature registered by the temperature sensor exceeds a maximum value. Said maximum value can be for example approximately 150° C. Exceeding the maximum value indicates that the cookware element is empty so that boiling cannot take place.

Another aspect of the invention relates to a method for operating a hob having at least one heating zone, a temperature sensor for detecting the temperature of a cookware element placed on the heating zone, and a control unit. In at least one operating mode the cookware element is heated up during a heating-up phase and the cookware element's temperature is regulated to a target temperature during a holding phase.

It is inventively proposed for a boiling point of the liquid in the cookware element to be detected during the heating-up phase and the target temperature to be determined as a function of the boiling point.

BRIEF DESCRIPTION OF THE DRAWINGS

Further advantages and characteristic features of the invention will emerge from the following description of the figures. An exemplary embodiment of the invention is shown in the figures. The drawings, the description, and the claims contain numerous features in combination. A person skilled in the relevant art will expediently also consider said features individually and combine them further to purposeful effect.

DETAILED DESCRIPTION OF EXEMPLARY EMBODIMENTS OF THE PRESENT INVENTION

Figure 1:
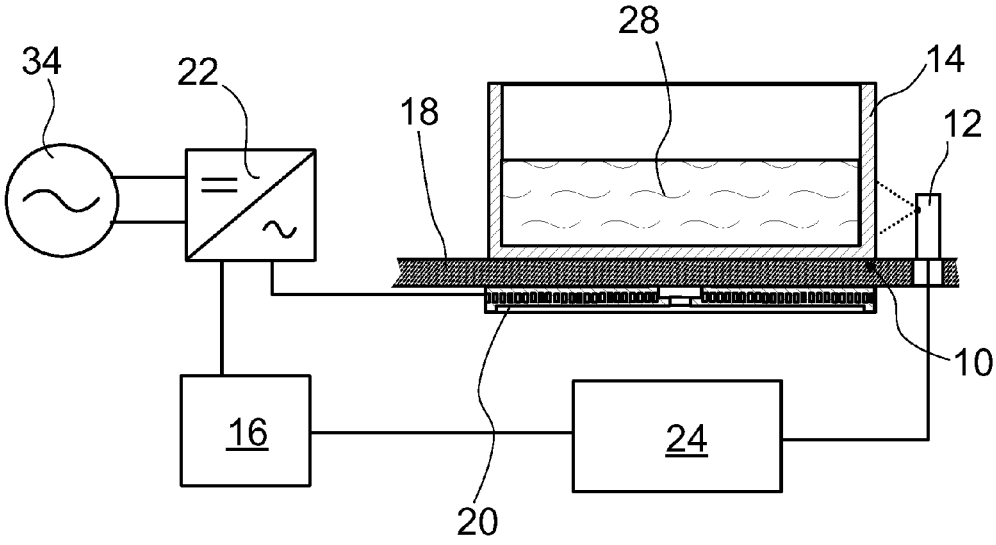
FIG. 1 is a schematic of an induction hob having a temperature sensor and a cookware element placed on a heating zone.

FIG. 1 shows a hob having a heating zone 10, a temperature sensor 12 for detecting the wall temperature of a cookware element 14 placed on the heating zone, and a control unit 16. Heating zone 10 is an area that is marked on a cover plate 18 of the hob and whose position and size correspond to the position and size of an inductor 20 located beneath cover plate 18. The hob is an induction hob and inductor 20 receives a high-frequency heating current from an inverter 22. Located between a domestic power-supply terminal 34 and inverter 22 is a rectifier that is not shown here. Control unit 16 determines the frequency and/or amplitude of the heating current produced by inverter 22 in such a way that, averaged over time, a specific heating power will be produced. Via inductor 20, the heating current produces a high-frequency alternating magnetic field which in turn produces high-frequency eddy currents in the base of cookware element 14. Cookware element 14 is heated through the dissipation of said eddy currents.

Temperature sensor 12 is an infrared temperature sensor that projects tower-like beyond the topside of cover plate 18 and detects infrared radiation being emitted from a side wall of cookware element 14. The signal detected by sensor 12 is processed by a sensor read-out unit 24 and forwarded to control unit 16. Sensor read-out unit 24 can perform, for example, low-pass filtering and/or scale-transforming.

In contrast to cover plate 18 having a tower-like temperature sensor, other exemplary embodiments of the invention are conceivable in which the temperature sensor is embodied as being an NTC element located beneath cover plate 18 or as being an infrared sensor located beneath the cover plate. It is also conceivable for temperature sensor 12 to be fixed directly to the wall of cookware element 14.

Control unit 16 is a universally programmable computing unit that performs a software-implemented method for operating the hob. The method has different operating modes. In a special operating mode, which could also be called a simmer mode, cookware element 14 is heated up during a heating-up phase 26 until a liquid 28 in cookware element 14 reaches its boiling point TB.

Control unit 16 keeps cookware element 14 at boiling point TB only until said point has been determined with sufficient accuracy. Control unit 16 then switches from heating-up phase 26 to a holding phase 32 during which the temperature of cookware element 14 or, as the case may be, liquid 28 will be regulated to a target temperature TS. The feedback from temperature sensor 12 is used for forming a closed control loop.

The correlation between the temperature of liquid 28 and the temperature of cookware element 14 or, as the case may be, the temperature of the radial outer wall of cookware element 14 can be ascertained by way of an empirically determined function. The outer wall's radiation losses as a rule result in there being a proportionality between the wall temperature of cookware element 14 and the temperature of liquid 28, which proportionality can be expressed by a constant factor. For the invention it is of secondary importance what value the boiling point TB of liquid 28 itself has. What matters is to precisely determine what the external temperature of cookware element 14 is when boiling point TB has been reached. Both temperatures TB, TS can be used equivalently owing to their proportionality.

Figure 2:
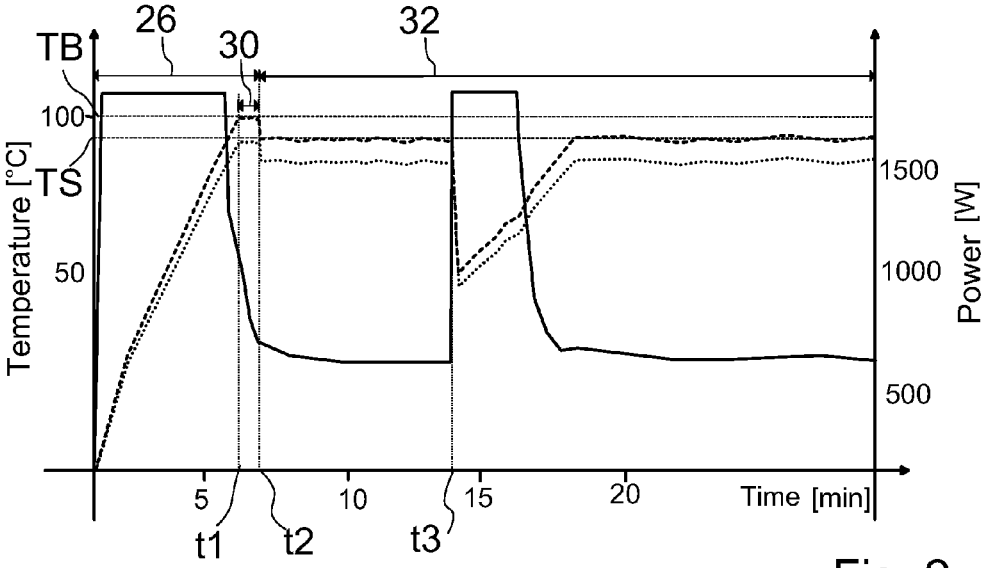
FIG. 2 shows the curves of a heating power, a wall temperature of the cookware element, and a temperature of something being cooked according to an exemplary embodiment of the invention.

FIG. 2 shows the time curve of a heating power (continuous line), the temperature of liquid 28 (dashed line), and the temperature of the wall of cookware element 14 (dotted line). Liquid 28 reaches boiling point TB at an instant t1 during heating-up phase 26 and its temperature in cookware element 14 will be substantially constant along a section 30 of the temperature curve. Control unit 16 averages the temperature measured in said section 30 by temperature sensor 12 and stores said temperature as the boiling point TB or, as the case may be, as the wall temperature, assigned to the boiling point, of cookware element 14. Control unit 16 switches at an instant t2 to holding phase 32 during which liquid 28 is kept as constantly as possible at a target temperature TS. That takes place in a closed control loop. If, say, at an instant t3 something more requiring to be cooked or more liquid 28 is added to cookware element 14, the liquid's temperature will briefly drop but will be raised again to the target temperature TS. If the drop in temperature is too great, in an exemplary embodiment of the invention the boiling point can be detected again to possibly allow for a changed composition of the liquid.

Control unit 16 determines the target temperature by subtracting a predefined stored value from the previously detected boiling point TB. This subtracted temperature difference can be, for instance, 5° C. so that for pure water at standard atmospheric pressure the target temperature will be 95° C. Food is cooked in substantially the same way at 95° C. as in water that is vigorously boiling at 100° C. so that evaporation energy can be saved with little adverse effect on the cooking process.

Figure 3:
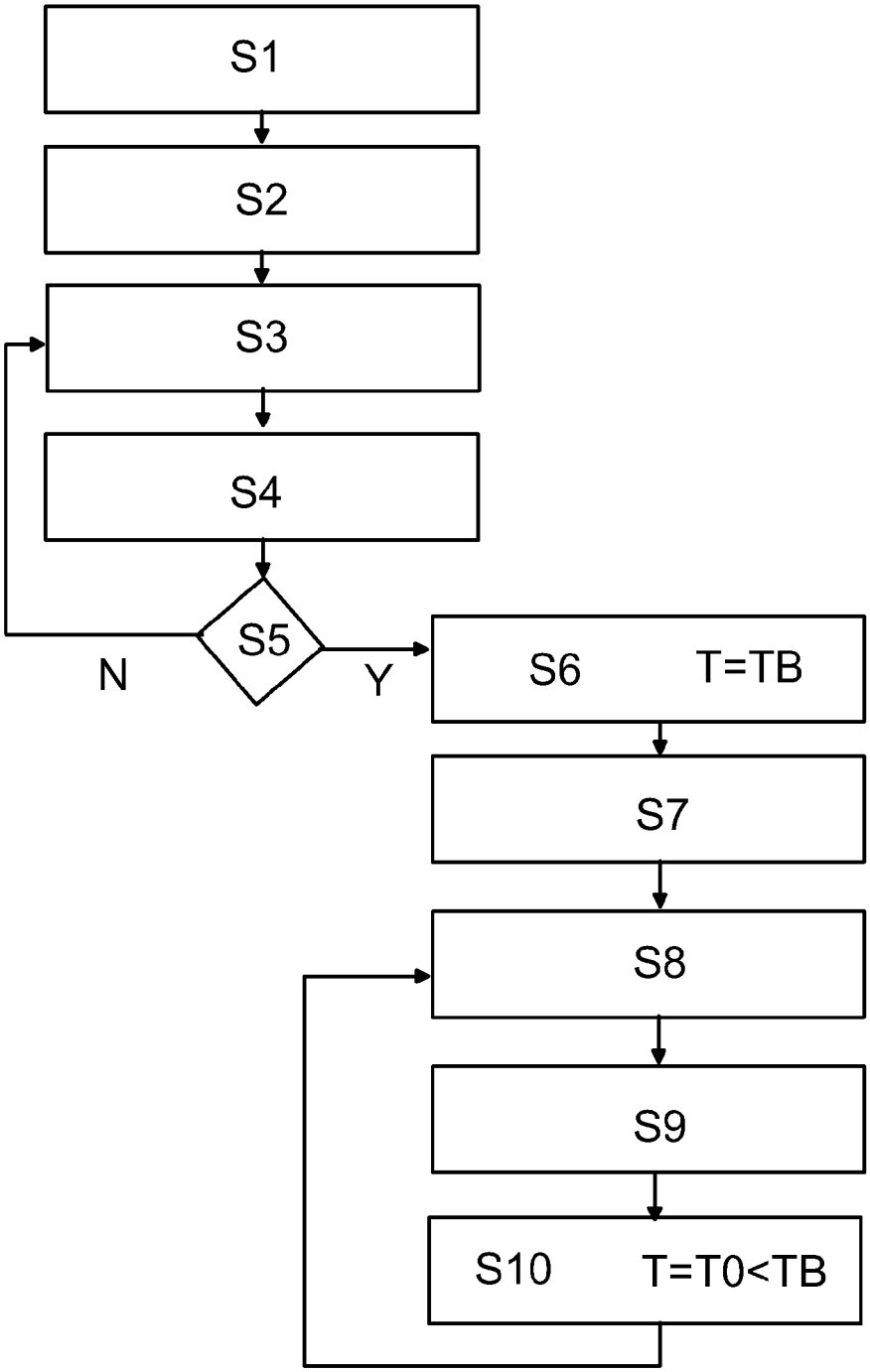
FIG. 3 is a flowchart of a method for operating an inventive hob.

FIG. 3 is a flowchart of performing the inventive method. Temperature sensor 12 that can be lowered into cover plate is activated at a step S1 and moved up from its lowered position into an activation position. Heating-up phase 26 is started at a step S2. The temperature of the outer wall of cookware element 14 is measured at a step S3 and at a step S4 an estimation of the temperature of liquid 28 is ascertained from said temperature by multiplying it by a constant. Control unit 16 judges at a step S5 whether liquid 28 is boiling or not. Control unit 16 for that purpose assesses the temperature recorded after the last measurements and checks whether except for unavoidable fluctuations it is constant. If it is, the boiling point TB has been reached. If it is not, the method will branch back to step S3 and perform another measurement.

Emergency shutdown (not shown) will take place if a temperature that is above a maximum temperature is detected at step S5.

If it is established at step S5 that boiling point TB has been reached, control unit 16 will at a step S6 compute target temperature TS for liquid 28 and proceed at a step S7 to holding phase 32. In a closed control loop the temperature of cookware element 14 is measured at a step S8, the temperature of liquid 28 is computed from the temperature of cookware element 14 at a step S9, and the heating power is regulated at a step S10 as a function of the result. If the temperature of liquid 28 is above the target temperature, the heating power of inductor 20 will be reduced by varying the frequency of inverter 22. The heating energy of inductor 20 will be increased if the temperature is below target temperature TS. The method will branch back to step S8 when the heating energy has been adjusted.

REFERENCE CHARACTERS

10 Heating zone
12 Temperature sensor
14 Cookware element
16 Control unit
18 Cover plate
20 Inductor
22 Inverter
24 Sensor read-out unit
26 Heating-up phase
28 Liquid
30 Section
32 Holding phase 34 Domestic power-supply terminal
TS Target temperature
TB Boiling point

The invention claimed is:

1. A hob, comprising:

at least one heating zone;

a temperature sensor for detecting a temperature of a cookware element placed on the heating zone; and a control unit for operating the heating zone, said control unit being constructed to heat up the cookware element during a heating-up phase in at least one operating mode and to regulate the temperature of the cookware element to a target temperature during a holding phase, said control detecting a boiling point of liquid in the cookware element during the heating-up phase based upon the temperature of the cookware element and determining the target temperature as a function of the temperature of the cookware element when the boiling point is detected.

2. The hob of claim 1, wherein the heating-up phase lasts until a changeover instant after the boiling point has been reached.

3. The hob of claim 1, wherein the target temperature is a predefined temperature difference lower than the temperature of the cookware element when the control detects the boiling point.

4. The hob of claim 3, wherein the temperature difference is between 2° C. and 7° C.

5. The hob of claim 1, wherein the control unit records a temperature curve of the cookware element during the heating-up phase, detects a substantially constant section along the temperature curve, and calculates an average of the temperature within the constant section.

6. The hob of claim 5, wherein the control unit calculates a gradient of the temperature curve for detecting the constant section.

7. The hob of claim 1, wherein the control unit deactivates the operating mode and produces a warning signal when the temperature registered by the temperature sensor exceeds a maximum value.

8. A method for operating a hob, comprising:

detecting a temperature of a cookware element placed on a heating zone and heated up during a heating-up phase in at least one operating mode;

detecting a boiling point of liquid contained in the cookware element during the heating-up phase of the cookware element;

regulating the temperature of the cookware element to a target temperature during a holding phase; and determining the target temperature as a function of the temperature of the cookware element when the boiling point is detected.

9. A cooktop comprising:

a heating zone;

a temperature sensor that detects a temperature;

a controller that receives a temperature signal from the temperature sensor, that determines when a boiling point of a liquid is reached based upon the received temperature signal, and that calculates a target temperature based upon the temperature signal when the controller determines that the liquid has reached a boiling point.

10. The cooktop of claim 9, wherein the temperature sensor detects a temperature of the liquid.

11. The cooktop of claim 9, wherein the temperature sensor detects a temperature of a cookware element in the heating zone and containing the liquid.

12. The cooktop of claim 9, wherein the controller determines that the boiling point is reached when the temperature signal becomes substantially constant.

13. The cooktop of claim 9, wherein the controller determines that the boiling point is reached when a slope of a curve of the temperature signal over time becomes substantially zero.

14. The cooktop of claim 9, wherein the controller calculates a target temperature by subtracting between 2 and 7 degrees Celsius from the temperature when the controller determines that the boiling point of the liquid has been reached.

15. The cooktop of claim 9, wherein the controller further calculates an average temperature over a period of time after the boiling point is reached and calculates the target temperature based upon the calculated average temperature.

16. The cooktop of claim 9, wherein the controller further operates the heating zone during a heating phase in an operating mode to raise the temperature and operates the heating zone during a holding phase of the operating mode to maintain the temperature near the target temperature.

* * * * *

UNITED STATES PATENT AND TRADEMARK OFFICE

CERTIFICATE OF CORRECTION

PATENT NO. : 8,530,798 B2
APPLICATION NO. : 13/375244
DATED : September 10, 2013
INVENTOR(S) : Aldana Arjol et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 24 days.

Signed and Sealed this
Fifteenth Day of September, 2015

Michelle K. Lee

Michelle K. Lee
*Director of the United States Patent and Trademark Office*